US005816744A

United States Patent [19]

Garren

[11] Patent Number: 5,816,744

[45] Date of Patent: Oct. 6, 1998

[54] UNDERWATER CABLE BURIAL MACHINE HAVING TRIPABLE PLOWS

[75] Inventor: Donald Lee Garren, Winston-Salem, N.C.

[73] Assignee: AT & T Corp, Middletown, N.J.

[21] Appl. No.: 630,110

[22] Filed: Apr. 8, 1996

[51] Int. Cl.[6] ..... F16L 1/04

[52] U.S. Cl. ..... 405/158; 37/232; 405/174; 172/265

[58] Field of Search ..... 405/158–164, 405/174–183; 37/232; 172/265

[56] References Cited

U.S. PATENT DOCUMENTS

| | | | |
|---|---|---|---|
| 3,089,264 | 5/1963 | Davis | 37/232 X |
| 3,151,406 | 10/1964 | Fryer | 37/232 X |
| 3,517,748 | 6/1970 | Fischer | 172/265 X |
| 3,650,054 | 3/1972 | Hanson | 37/232 |
| 3,950,530 | 4/1976 | Spearman | 405/164 |
| 4,570,366 | 2/1986 | Yost | 37/232 |
| 4,802,793 | 2/1989 | Grinsted et al. | 405/161 |
| 4,936,707 | 6/1990 | Shishkin et al. | 405/174 X |

FOREIGN PATENT DOCUMENTS

| | | | |
|---|---|---|---|
| 1559550 | 3/1969 | France | 37/232 |
| 2301165 | 9/1976 | France | 172/265 |
| 2419662 | 11/1979 | France | 172/265 |
| 2521820 | 8/1983 | France | 172/265 |
| 0591545 | 2/1978 | U.S.S.R. | 37/232 |
| 2036129 | 6/1980 | United Kingdom | 405/162 |
| 2069094 | 8/1981 | United Kingdom | 405/161 |

*Primary Examiner*—Dennis L. Taylor

[57] ABSTRACT

A cable burying machine having three plow blades which are mounted on a rotating disk. The disk is restrained from movement in normal operation, but if the active plow blade encounters an obstacle which imposes more than a preset force on the blade, the disk will automatically rotate, preventing damage to the blade, and bringing the next blade into position. A remotely operable tripping mechanism can be used to reduce the amount of resistance to rotation which was preset, thereby allowing an operator on a surface vessel to command a plow rotation to remove debris from the active plow blade.

14 Claims, 7 Drawing Sheets

UNDERWATER CABLE BURIAL MACHINE HAVING TRIPABLE PLOWS

BACKGROUND OF THE INVENTION

The present invention relates to underwater cable burial machines. In particular, the invention relates to an underwater cable burying machine having a rotatable, tripable plow with a plurality of blades.

Underwater burial machines are used to bury communications cables in the sea bottom in an effort to protect the cables from damage. These machines plow a groove in the seabed beneath a body of water, and they simultaneously lay a cable into the groove which they have plowed. Burial machines have heretofore used a single, fixed plow blade to cut a groove into the seabed immediately in front of a cable laying mechanism. The cable is then placed into the groove thus formed in order that it will be somewhat beneath the surface of the seabed. After the cable has been laid into the groove, water pressure and underwater currents eventually cause the vertical walls of the groove to collapse and move sand and soil into the groove, thereby covering the cable and assisting in the overall burial operation.

A problem with the burial machines of the prior art is that they have typically employed a single, fixed plow blade. Consequently, if a large obstacle is struck as the burial machine is towed by a vessel, it could cause damage to the plow blade, or it could cause the machine to hang up. In the event that the machine becomes stuck, it is possible for the towing cable to break, which can result in the loss of the machine. Further, it is possible for debris, such as fishing nets, abandoned cables, or other items, to become hung up, or for soil to collect on the fixed plow blade of the prior art.

Yet another problem with the designs used heretofore, is that even in normal operation, there is wear on the plow blade limiting the time that the plow, and, consequently, the burial machine, can remain in continuous operation. As the plow blade machine tends to wear, any time required to retrieve the machine from the seabed interrupts the plowing operation, and results in some portion of the cable not being buried. This is a consequence of the fact that when the machine is retrieved onto the surface vessel for maintenance to the plow blade, and then later returned to the seabed, a portion of the cable (which must come up to the vessel with the machine) is not buried, so some cable will remain unburied on the seabed between the locations where the machine was recovered and where the plowing operation is subsequently commenced.

In view of the foregoing problems with the plow blades of the prior art, an improved plow which can overcome these problems would be desirable.

SUMMARY OF THE INVENTION

In accordance with the present invention, a new design approach has been disclosed which solves many of the problems heretofore associated with existing underwater burial machines. The new design uses an efficient configuration for the plow which preferably employs a rotatable plow having three plow blades which are mounted on a shaft.

The shaft will rotate, automatically bringing a new plow blade into the active plowing position in the event that an obstruction is struck which imposes more than a preset force on the plow blade in the active plowing position.

Alternatively, an operator on the surface vessel which is towing the cable burial machine can remotely trip the rotation mechanism, whereby a new plow blade will rotate into the active plowing position, thereby allowing the operator to rotate a blade which has collected debris out of the active plowing position without stopping the plowing operation.

Detailed Description of the Preferred Embodiment of the Invention

Figure 1:
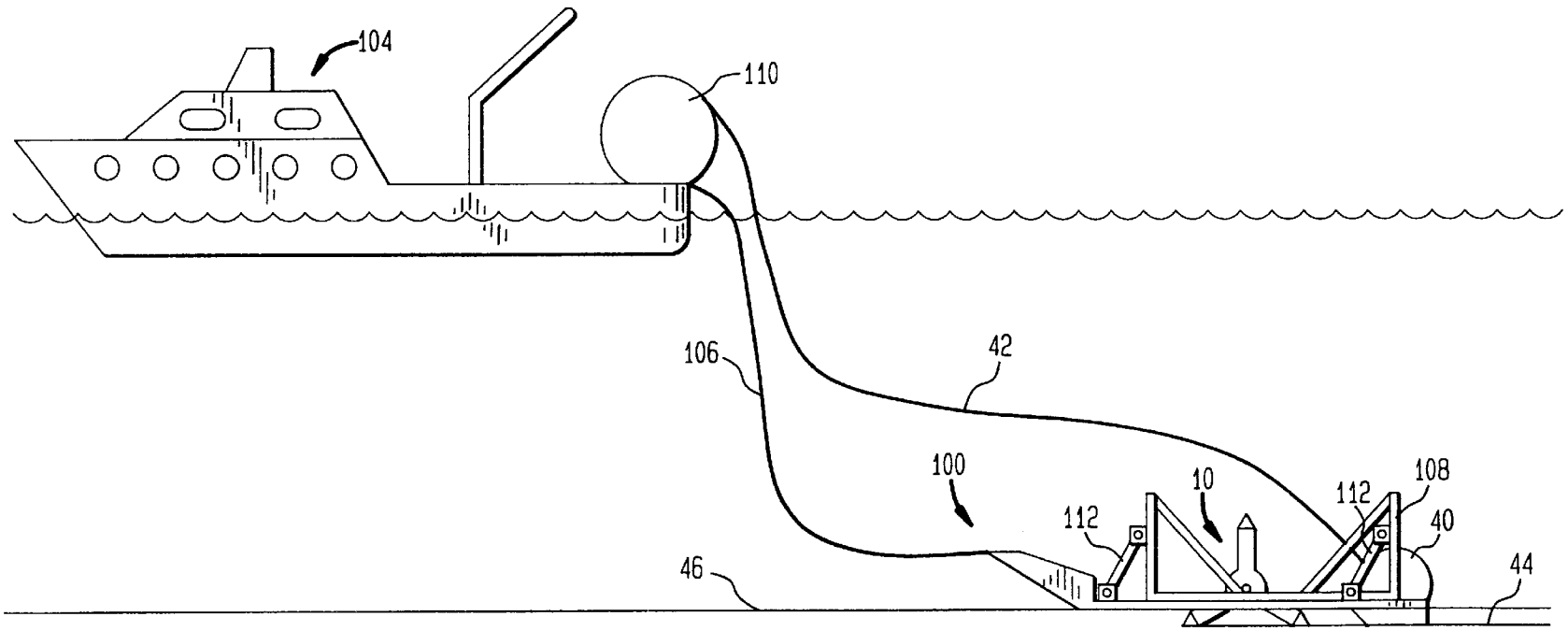
FIG. 1 is a side view illustrating the improved plow of the present invention being towed by a surface vessel in a cable laying operation.

Referring to FIG. 1, a simplified side view of the rotating plow 10 of the present invention is shown in use in a cable laying operation. The plow 10 is mounted on a sea sled 100 which is being towed along the seabed 46 by a vessel 104. The towing is accomplished by means of a combination towing/umbilical cable 106.

During the towing operation, a communications cable 42 is unspooled from a spool 110 on the vessel 104. As the sled 100 is pulled forward, the plow 10 cuts a groove 44 in the seabed 46, and the communications cable 42 is laid into that groove 44 by cable laying apparatus 40 on the rear of a carriage 108 which is fixed to the sled 100 using a four bar linkage 112. As will be understood by those skilled in the art, the four bar linkage 112 allows the carriage 108 to be moved up and down relative to the sled 100. This permits the plow 10 and cable laying apparatus 40, both of which are attached to the carriage 108, and both of which are shown to extend through the flat bottom of the sled 100, to be moved up and down relative to the bottom of the sled 100. The four bar linkage 112 allows the plow 10 and the cable laying apparatus 40 to be moved up above the bottom of the sled 100 when the sled 100 is recovered onto the deck of the vessel 104 for transportation or maintenance. In addition, the four bar linkage 112 can be used to adjust the depth of the groove 44 in the event that that becomes necessary due to the makeup of the seabed 46, i.e., if a rock layer is encountered below the surface of the seabed 46 at a depth which is less than the normal cable laying depth. By way of example, if the normal cable laying depth was twelve inches, and a rock layer was encountered ten inches below the surface of the seabed 46, then the four bar linkage 112 could be adjusted using hydraulic cylinders (not shown) so that the plow teeth only extended somewhat less than ten inches below the seabed 46, thereby preventing damage to the teeth while allowing the burial operation to continue.

As will be understood by those skilled in the art the combination towing/umbilical cable 106 is used to both tow the sled 100, and to carry hydraulic fluid and electrical signals between the vessel 104 and the sled 100.

Figure 2:
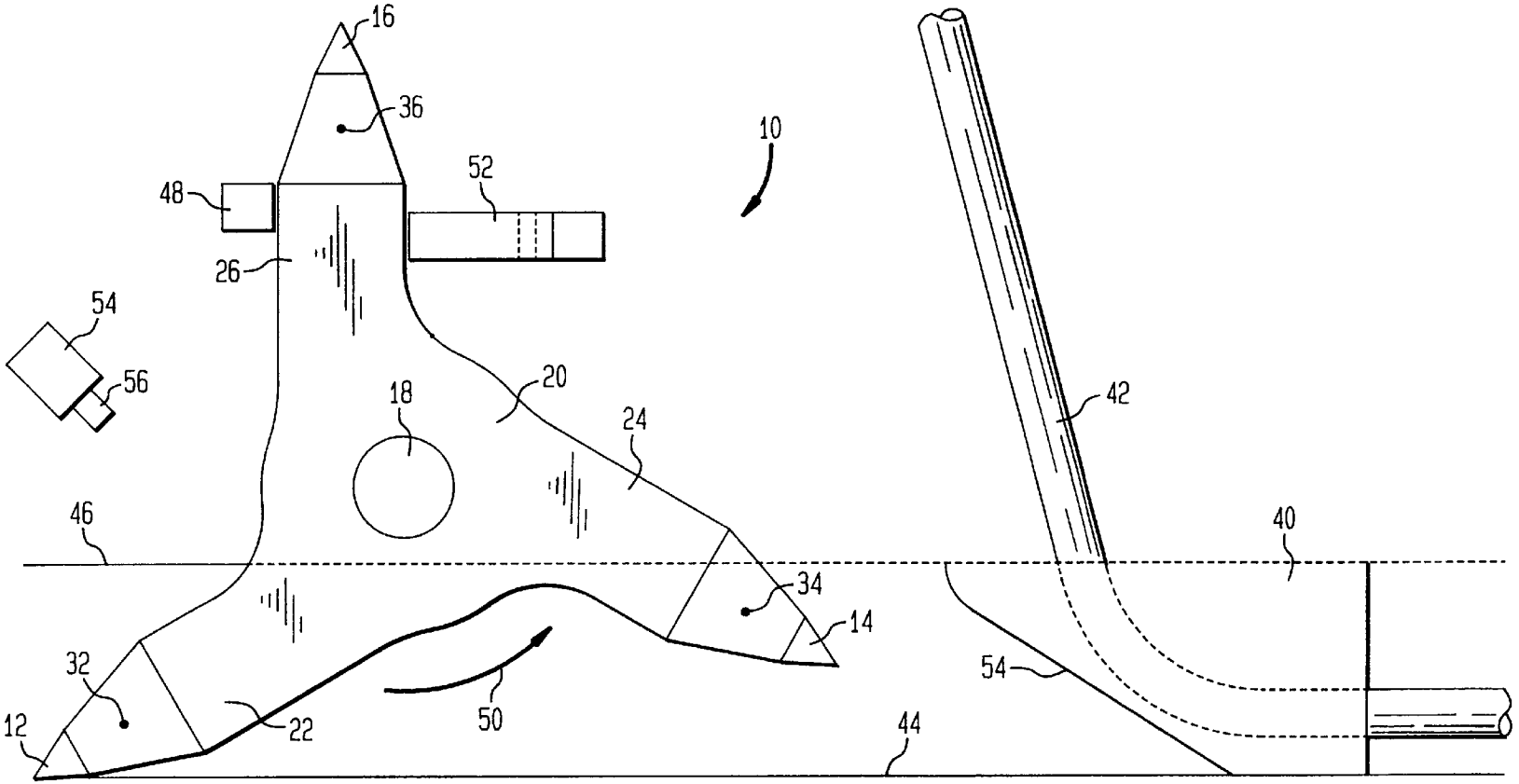
FIG. 2 is a front view illustrating the improved plow of the present invention.

Referring now to FIG. 2, in the preferred embodiment of the invention, the rotating plow 10 has three blade teeth 12, 14, 16, which are preferably spaced 120° apart on a plow body 20. The blade teeth 12, 14, 16 rotate around a common shaft 18 attached to the plow body 20. As will be understood by those skilled in the art, the provision of three blade teeth 12, 14, 16 should effectively triple the amount of use (relative to a fixed plow device) that the plow 10 of the present invention can achieve, even in normal usage. However, due to other advantages of the present invention, with respect to its ability to shed debris, and to prevent damage due to encountering hard objects, like large rocks and ledges, it is expected that the present invention will provide significantly greater use than the mere tripling which the three blade teeth 12, 14, 16 would otherwise be expected to achieve. Alternatively, it may be possible to use blade teeth made of less expensive, less durable material than those used in the prior art, while still obtaining a far greater period of use than the prior burial machines provided.

The three blade teeth 12, 14, 16 are mounted on blades 22, 24, 26, respectively, which extend from the central portion of the rotatable plow body 20. In the preferred embodiment of the invention, the blade teeth 12, 14, 16, are themselves commercially available, replaceable blade teeth which are made by Caterpillar Corporation for use on earth moving equipment, such as bulldozers. The blade teeth, 12, 14, 16, are held in place on the blades 22, 24, 26 by means of pins 32, 34, 36, respectively, which extend through the blade teeth 12, 14, 16, and are held in place by spring washers which cannot be seen, as they are beneath the surface of the blade teeth 12, 14, 16. Consequently, when the blade teeth 12, 14, 16 need to be replaced, it is a very simple operation to drive the pins 32, 34, 36 out, thereby allowing the blade teeth 12, 14, 16 to be removed from the blades 22, 24,26.

The cable burial machine also includes cable laying apparatus 40, for laying a cable 42 into a groove 44 formed in the seabed 46 as the burial machine is pulled forward, i.e., as it moves to the left as shown in FIGS. 1 and 2. Thus, as the vessel 104 pulls the burial machine 100 forward, cable 42 is unspooled from the vessel 104 and fed down to the burial machine 100 where the cable laying apparatus 40 lays it into the groove 44.

While it is intended that the cable laying operation go smoothly, the seabed may have obstacles, i.e., rocks, or other debris, which the plow 10 will encounter as it is pulled. In order to deal with such items, the plow 10 of the present invention includes an automatic trigger mechanism, the operation of which will be described below. Part of the automatic trigger mechanism is a sear 48 which normally prevents the plow 10 from rotating in a counterclockwise direction (as illustrated in FIG. 2) by making contact with the front surface of one of the blades 26, thereby preventing counterclockwise rotation of the plow body 20. With continued reference to FIG. 2, there is also an antirotation block 52, which can be pivoted (in a direction normal to the plane of FIG. 2), which prevents the plow body 20 from rotating in a clockwise direction. The operation of the sear 48 and the antirotation block 52 will be explained more fully hereinafter.

Should an obstacle be encountered which causes sufficient force to be applied to the active blade 22 (i.e., the one which is actually plowing), the forces on the active blade 22 will be transmitted through the rotatable body 20 to the blade 26 applying pressure against the sear 48. If the force applied to the sear 48 exceeds the preset restraining force, the trigger mechanism, will cause the sear 48 to be pushed away from the front of the blade 26, thereby allowing the plow body 20 to rotate. Thus, if the blade tooth 12 was to encounter a significant obstacle, the sear 48 would move out of the way to permit the plow 10 to rotate on its shaft 18 (in a counterclockwise direction, as indicated by arrow 50), and the next blade tooth 16 will "walk" over the obstacle. In the preferred embodiment of the invention, the force which is required to cause the sear 48 to permit the blade 26 to move is on the order of 50,000 pounds.

After the blade 26 has been released, forces on the active blade 22 will cause it to rotate in a counterclockwise direction, and it will continue to rotate until it is in the plowing position formerly occupied by blade 24. In the interim, as the plow body 20 rotates, blade 24 will rotate, pushing the antirotation block 52 out of its way, until it has rotated into the position formerly occupied by blade 26 where it will lock in place. As will be understood by those skilled in the art, as used herein, the term "lock" is relative, in that it means that the blade 24 will assume the prior position of blade 26, where it will be trapped between the sear 48 and the antirotation block 52. It will remain there until such time as the sear 48 is again released. Once the blade 26 has rotated into the position formerly occupied by blade 22, the cable burying operation will continue without damage to the plowing system, the towing cable, the communications cable 42, or the plow 10.

With continued reference to FIG. 2, it has been found that the best angle for forward plowing results from the active blade 22 forming an angle of around 30°, relative to the bottom of the groove 44. This angle has been found to cause the least amount of soil build up on the leading edge of the blade tooth 12 as it moves through the soil being plowed. In addition, the leading edge of the last blade tooth to have been used (i.e., blade tooth 14, as illustrated in FIG. 2) and the leading edge 54 of the portion of the cable laying mechanism 40 which extends into the groove 44 are also preferably formed to have an angle of about 30° relative to the bottom of the groove 44 (but reversed with respect to the 30° angle formed by the lead blade tooth 12. This optimal angle has been found to diminish the amount of soil and debris which collects on these parts.

Notwithstanding the optimization of the plowing angle, there will be times when the lead blade 22 collects soil or other debris. By way of example, it is not uncommon for old, abandoned telegraph cables or fishing nets to catch on the lead blade 22. If that occurs, the automatic trigger mechanism may not release the sear 48, due to insufficient force being applied to the blade 22, yet the overall operation may be slowed, and the debris which collects on the blade tooth 12 and the blade 22 may interfere with or decrease the efficiency of the cable laying operation. Accordingly, the present invention 10 also includes a remotely operable tripping mechanism (described below), which reduces the force needed to allow the sear 48 to open to allow blade 26 to move past the sear 48.

In plowing operations, it is quite common to have one or more TV cameras mounted on the burial machine 100. Accordingly, it is contemplated that in the operation of the plow 10 a TV camera 54 would be mounted on the burial machine 100 with its lens 56 pointed toward the plow 10 so that an operator on board the surface vessel 104 can visually monitor the plowing operation. Consequently, if the plow 10 started to pick up debris, the operator could remotely operate the tripping mechanism to reduce the force needed to move the sear 48 away from the front surface of blade 26, thereby assuring that any minimal amount of force on blade 22 will be sufficient to move the sear 48 out of the way and allow rotation of the plow body 20. Thus, even in those situations where debris becomes snagged on the plow 10, but where the force exerted is insufficient to cause the automatic trigger mechanism to release the sear 48, it is still possible for an operator on the surface vessel 104 to reduce the force needed to operate the automatic trigger mechanism so that whatever (minimal amount of) force is present will be sufficient to open the sear 48 and allow the plow body 20 to rotate, thereby allowing the active blade tooth 12 to go from a point forward position, through a point downward position, to a point rearward position (i.e., to the position occupied by blade 24 and blade tooth 14 in FIG. 2). This movement will allow the point 12 and blade 22 to drop any collected debris, while bringing a new blade tooth 16 into plowing position.

Figure 3:
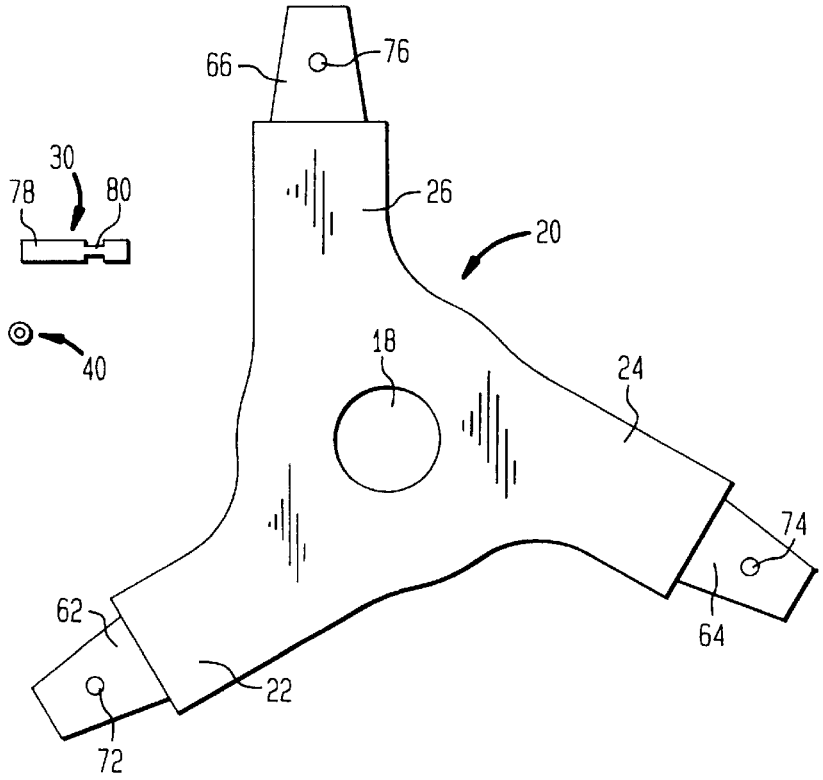
FIG. 3 is a front view illustrating the plow body of the present invention without the blade teeth and also illustrating the pin which is used to retain the blade teeth on the plow.

Referring to FIG. 3, a view of the plow body 20, with the blade teeth 12, 14, 16 removed, is shown. As shown in FIG. 3, blade tips 62, 64, 66 extend from the blades 22, 24, 26, respectively. The blade tips 62, 64, 66, each have holes 72, 74, 76, respectively, formed therethrough. Accordingly, when the blade teeth 12, 14, 16 are installed over the blade tips 62, 64, 66, holes formed through the blade teeth 12, 14, 16, will be in alignment with the holes 72, 74, 76 in the blade tips 62, 64, 66. With further reference to FIG. 3, a pin 30 is shown to have a shaft 78, with a constricted portion 80, formed thereon. A spring washer 40 having an opening 86 formed therein is also shown. The pin 30 and the spring washer 40, are typically made of steel. However, the spring washer 40 has a small opening formed in the steel (i.e., it is not a closed circle), so that the pin 78 can be driven through it, expanding the opening enough to allow the constricted portion 80 to capture the spring washer 40 as the pin 30 is forced through the spring washer 40. Note that the constricted portion 80 is offset from the center of the pin 30, as it will be placed into a depression on one side of the blade tip 66 when the blade tooth is installed on the blade tip 66. Also, as the spring washer 40 is covered with a resilient material, the opening in the steel ring cannot be seen in FIG. 3 To install blade tooth 16 on blade tip 66, a spring washer 40 is placed into the opening 76, and blade tooth 16 (not shown in FIG. 3) is placed over the blade tip 66. Then pin 36 is driven in until its restricted portion 80 is captured by the spring washer 40. Thus, when the blade teeth 12, 14, 16 are installed on the blade tips 62, 64, 66, and pins 32, 34, 36 are driven in to retain the blade teeth 12, 14, 16 the blade teeth 12, 14, 16 will be retained on the blades 22, 24, 26, as shown in FIG. 2, until the pins 32, 34, 36 are driven out.

Figure 4:
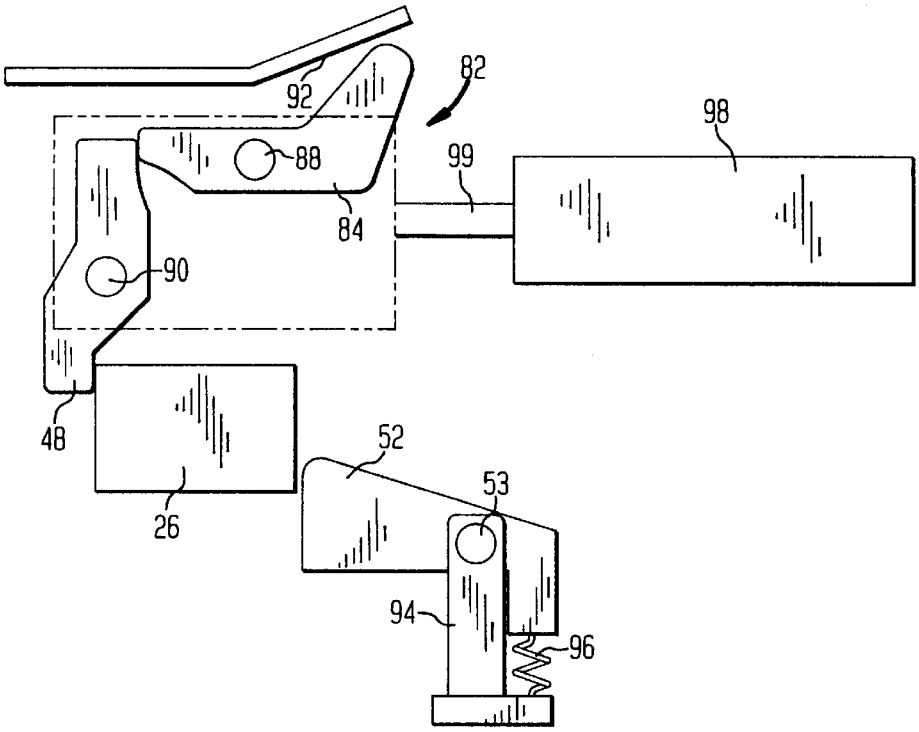
FIGS. 4–7 are a top views illustrating the operation of the automatic trigger which normally prevents the plow from rotating and the antirotation block.

Referring now to FIGS. 4–8, the operation of the trigger mechanism 82 will be explained. With reference to FIG. 4, a top view of a portion of the trigger mechanism 82 is shown. The dotted lines show the portion of the trigger mechanism 82, namely the sear 48 and the trigger 84, which moves on an arm 86 which is attached to the plow shaft 18 (See FIG. 8). Also shown in FIGS. 4–7 are a cross-section through the uppermost blade 26, a cam surface 92, a top view of the antirotation block 52, the antirotation block mounting 94, the antirotation block spring 96, and a hydraulic cylinder 98 (which attaches to the moving portion of the trigger mechanism 82 by means of the cylinder shaft 99). Portions of the trigger mechanism, namely the cam surface 92, the antirotation block mounting 94, the antirotation block spring 96, and the hydraulic cylinder 98 are all fixed to the carriage 108 (which is shown in FIG. 1).

With continued reference to FIG. 4, the normal plowing position is shown with the blade 26 "locked" in place between the sear 48 and the antirotation block 52. The shaft 99 of the hydraulic cylinder 98 is fully retracted, and the trigger 84 is not depressed by the cam surface 92. Both the sear 48 and the trigger 84 are biased by springs (not shown) to rotate in a counterclockwise manner, as shown in FIGS. 4–7. However, stops (not shown) are provided to prevent the sear 48, or the trigger 84 from rotating any further in the counterclockwise direction than the positions in which they are shown in FIG. 4. The hydraulic cylinder 98 provides sufficient restraining force to the blade 26, through the trigger mechanism 82 and the sear 48, that the blade 26 will be held in place during normal plowing operations.

Figure 5:
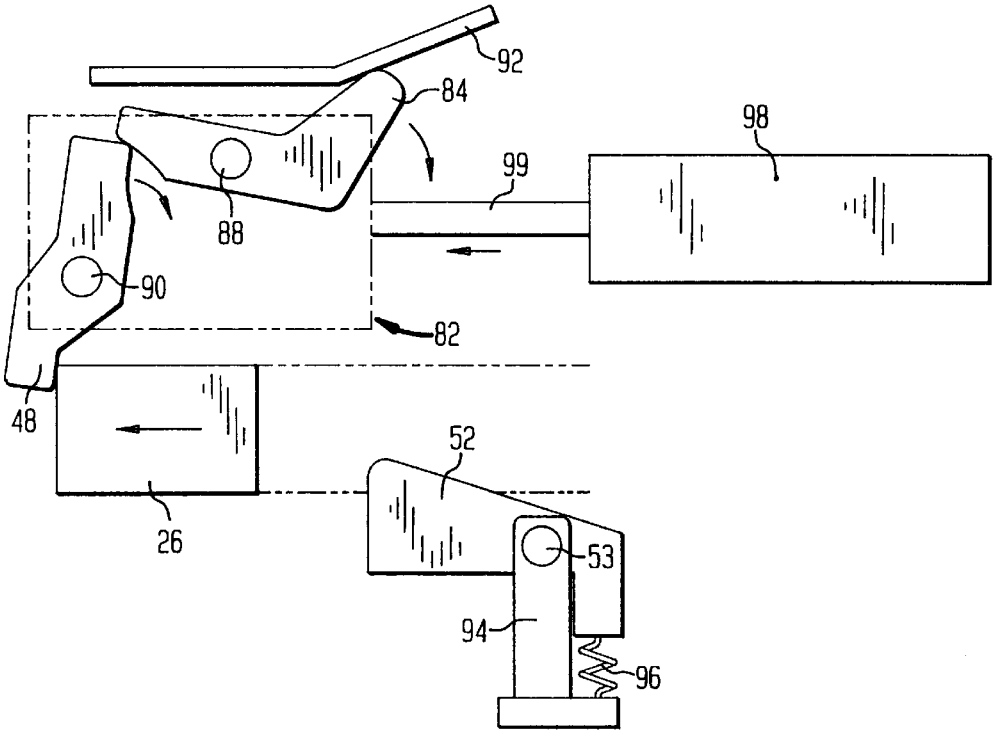

With reference now to FIG. 5, if the active blade 22 (See FIG. 2) strikes an object, the forces on blade 26 will cause blade 26 to move to the left (as illustrated by the arrow on blade 26). This will force the trigger mechanism 82 to move to the left, extending the shaft 99 from the hydraulic cylinder 98 (see arrow). As the trigger mechanism 82 moves away from the hydraulic cylinder 94, the trigger 84 will contact the cam surface 92, rotating the trigger 84 in a clockwise direction (see arrow) around the trigger pivot 88 against the force of the trigger spring. This rotation of the trigger 84 allows the sear 48 to rotate in a clockwise direction around the sear pivot 90 (see arrow), against the force of the sear spring.

Figure 6:
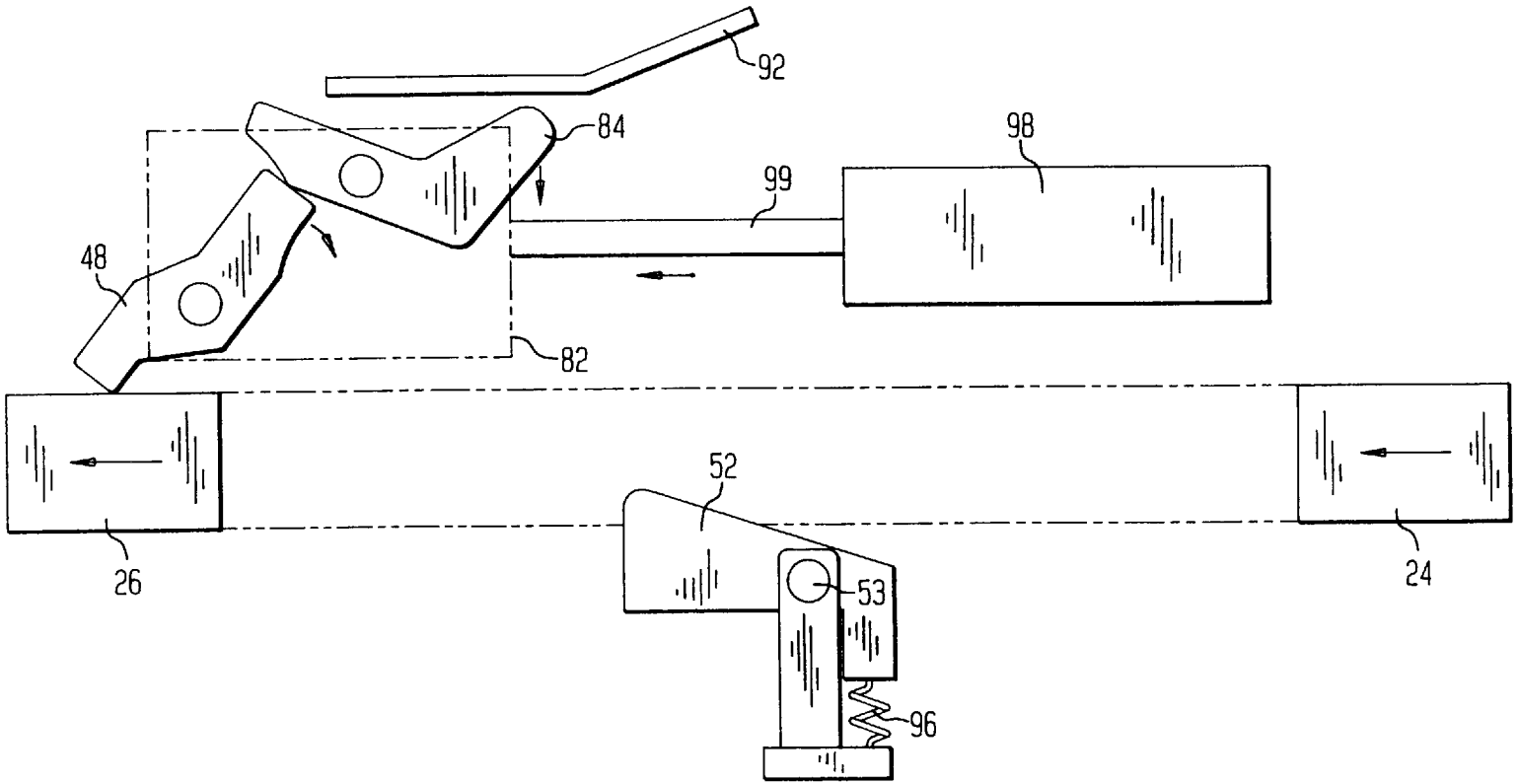

Referring now to FIG. 6, continued pressure on the active blade 22 (See FIG. 2) causes additional movement of the trigger 84 against the cam surface 92, further rotating the trigger 84, allowing the sear 48 to be pushed by the blade 26, and fully extending the shaft 99 from the hydraulic cylinder 98. This continued movement of the blade 26 corresponds to rotation of the plow body 20 (See FIG. 2), so blade 24 will start to rotate into position.

Figure 7:
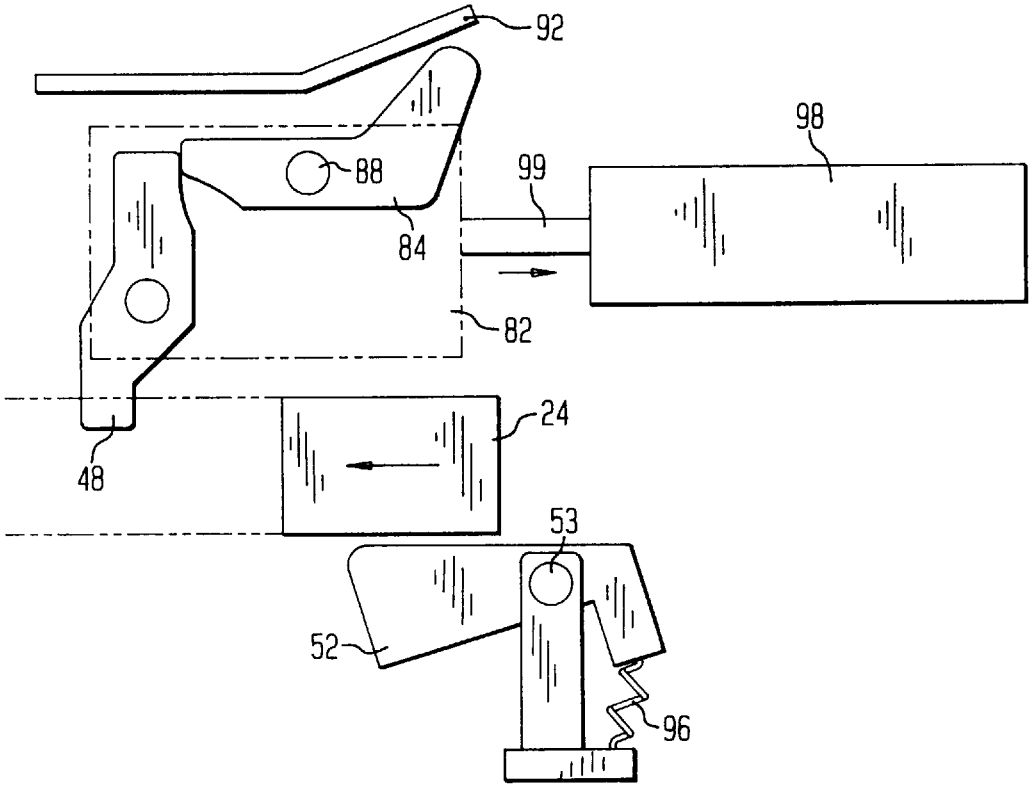

Once blade 26 has moved past the sear 48, sensors (not shown) will recognize that the blade 26 has rotated beyond the sear 48, and they will signal electronics controlling the hydraulic circuit to pull the shaft 99 back into the hydraulic cylinder, as shown in FIG. 7. Also, the sear spring will cause the sear 48 to rotate back to its counterclockwise stop. As the trigger mechanism 82 moves back toward the hydraulic cylinder 98, the trigger spring will cause the trigger 84 to rotate back to its counterclockwise stop, as the trigger 84 rides against the cam surface 92. As this is occurring, the plow body 20 will continue to rotate blade 24 into the position formerly occupied by blade 26. The movement of blade 24 against the back (cammed) surface of the antirotation block 52, causes the antirotation block 52 to rotate against the pull of the antirotation block spring 96, until the blade 24 has passed the antirotation block 52, which will then be pulled back into its "lock" position (See FIG. 4) by the antirotation spring 96. At that time, blade 26 will be in the normal plowing position, and blade 24 will be in the "locked" position formerly occupied by blade 26.

Figure 8:
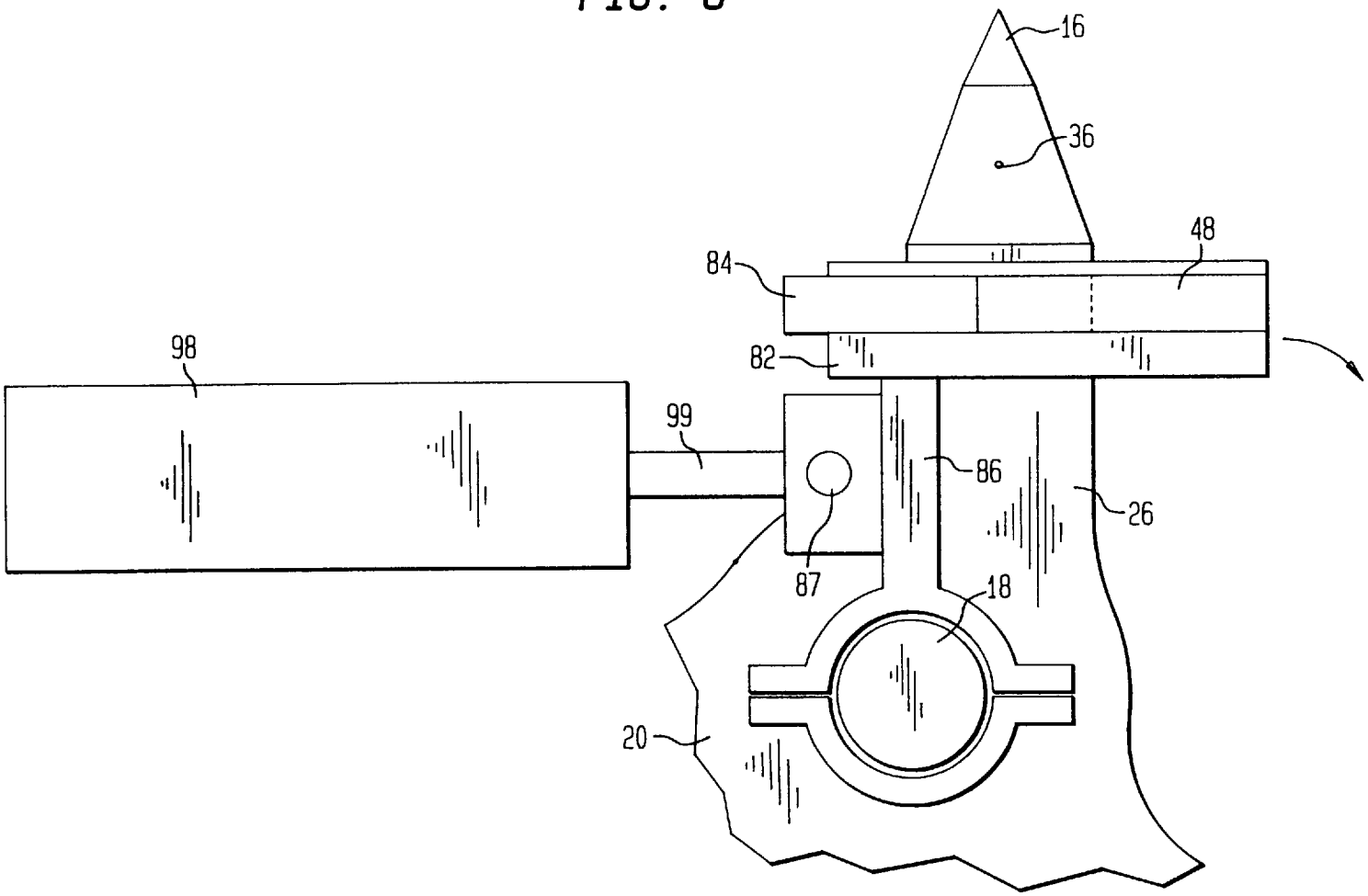
FIG. 8 is a rear view showing the rotatable arm on which the trigger and the sear are located.

With reference to FIG. 8, the trigger mechanism 82 is shown (from the rear side of blade 26, as viewed from FIG. 2). The trigger mechanism 82 is mounted on an arm 86 which is attached to the plow shaft 18, as shown. Accordingly, if the active plow blade 22 is subjected to a force, blade 26 will start to rotate in the clockwise direction, moving arm 86 clockwise (see arrow). This movement of the trigger mechanism 82, was shown in, and explained with reference to, FIGS. 4–7. This movement will be against the restraining force supplied by hydraulic cylinder 98 through shaft 99, which is attached to a bracket 87 which is affixed to the arm 86. As the operation of the trigger 84, the sear 48 (shown in shadow), and the trigger mechanism has already been explained, no further explanation of the trigger mechanism is required.

Finally, as stated above, the present invention includes means which permits an operator on the vessel 104 to remotely release the hydraulic restraining force which holds the cylinder armature 99 in. When the operator commands a trip, the hydraulic pressure in the cylinder 98 is reduced to a very low amount, e.g., 100 pounds, as compared to the normal value, typically 50,000 pounds. Consequently, even minimal forces on the active plow blade 22 will cause blade 26 to move forward and into the active plowing position, as explained above.

As will be obvious to those skilled in the art, numerous changes can be made to the preferred embodiment of the invention without departing from the spirit or scope of the invention described herein. By way of example, while a hydraulic restraining force was described, it would be possible to use a spring to restrain movement of the trigger mechanism arm 86 instead of the hydraulic cylinder 98 described herein. Similarly, while the remotely operated trigger mechanism is preferably comprised of means for reducing the hydraulic restraining force, it would be possible to modify the antirotation block mounting 94, so that it included a hydraulic cylinder, rather than being fixed, so that it could "push" the blade with sufficient force to overcome the preset force restraining blade movement past the sear 48.

Other modifications and variations could also be made to the preferred embodiment of the invention without departing from the present teachings.

I claim:

1. A plow for a cable burying machine comprising:

a shaft connected to a cable burying machine body;

a plurality of rotatable blades, mounted on said shaft, for plowing a groove in a surface;

a plurality of removable plow blade tips, wherein one of said plurality of removable plow blade tips is mounted to one of said plurality of rotatable blades;

a retainer, connected to said cable burying machine body, for maintaining one of said plurality of rotatable blades in an locked plowing position relative to said cable burying machine body by applying an opposing force to one of said plurality of rotatable blades; and a means for towing said plow over said surface.

2. The plow of claim 1, wherein said plurality of rotatable blades consists essentially of three blades arranged around the periphery of said circular body about 120° degrees apart.

3. The plow of claim 1, wherein said retainer further comprising means for automatically releasing one of said rotatable blades in the event that more than a preset force is applied to said retainer.

4. The plow of claim 3 wherein said retainer is comprised of a sear and a trigger, said trigger preventing movement of said sear, and said sear retaining one of said plow blades in position until said retained plow blade imposes more than said preset force on said sear.

5. The plow claim 4 wherein said trigger contacts, and is rotated by, a cam when said retained plow blade pushes against said sear with more than said preset force.

6. The plow claim 4 wherein said rotation of said trigger allows said sear to rotate out of the way of said retained plow blade, whereby said circular body will rotate and bring another plow blade into plowing position.

7. The plow of claim 3 further comprising manually operated means for remotely reducing said preset force.

8. The plow of claim 2 wherein the blade which is in the locked plowing position forms an angle of about 30° with the base of the cable burying machine.

9. A plow for a cable burying machine comprising:

a rotatable blade means for plowing a groove, said blade means connected to said cable burying machine;

a removable plow blade tips means mounted to said rotatable blades means;

a retaining means for retaining said rotatable blade means in a bound plowing position, said retaining means connected to said cable burying machine;

an automatically releasing means, connected to said retaining means, for releasing said rotatable blades means from said retaining means in the event that more than a preset force is applied to said retaining means; and a mean for towing said plow over said surface.

10. The plow of claim 9 wherein said rotatable blades means is comprised of a circular body and three plow blades arranged around the periphery of said circular body about 120° degrees apart;

wherein said rotatable blade means in a bound plowing position is one of said three rotatable plow blades; and wherein said plow blade bound in the plowing position forms an angle of about 30° with the base of said cable burying machine.

11. The plow of claim 9 wherein said retaining means is comprised of a sear and a trigger;

wherein said trigger preventing movement of said sear, and said sear retains one of said plow blades in position until said retained plow blade imposes more than said preset force on said sear;

wherein said trigger contacts, and is rotated by, a cam when said retained plow blade pushes against said sear with more than said preset force; and wherein said rotation of said trigger allows said sear to rotate out of the way of said retained plow blade, whereby said circular body will rotate and bring another plow blade into plowing position.

12. The plow of claim 9 further comprising a manually operated means for remotely reducing said preset force to induce the releasing of one of said rotatable blades means from said retaining means.

13. A rotatable plow for a cable burying machine comprising:

three rotatable plow blades arranged about 120° degrees apart around the periphery of a circular body, wherein said circular body is connected to said cable burying machine and;

three removable plow tips, one of said low tips mounted on one of said three rotatable plow blades;

a retainer for maintaining one of said three rotatable blades in an locked plowing position, wherein said retainer is connected to said cable burying machine; and wherein said blade which is in the locked plowing position forms an angle of about 30° with the base of the cable burying machine.

14. The rotatable plow of claim 13 wherein said retainer comprising;

a sear and a trigger;

wherein said trigger preventing movement of said sear, and said sear retains one of said three plow blades in position until said retained plow blade imposes more than said preset force on said sear;

wherein said trigger contacts, and is rotated by, a cam when said retained plow blade pushes against said sear with more than said preset force; and wherein said rotation of said trigger allows said sear to rotate out of the way of said retained plow blade, whereby said circular body will rotate and bring another plow blade into plowing position.

* * * * *